US005310050A

United States Patent [19]

Sutherland

[11] Patent Number: 5,310,050

[45] Date of Patent: May 10, 1994

[54] WRAP-AROUND CARRIER WITH FLEXIBLE HEEL APERTURE

[75] Inventor: Robert L. Sutherland, Kennesaw, Ga.

[73] Assignee: Riverwood International Corporation, Atlanta, Ga.

[21] Appl. No.: 83,128

[22] Filed: Jun. 24, 1993

[51] Int. Cl.[5] ..... B65D 75/06

[52] U.S. Cl. ..... 206/147; 206/194; 206/197

[58] Field of Search ..... 206/194, 197, 199, 139, 206/141, 145, 147, 148, 149, 151, 156, 158, 175, 427

[56] References Cited

U.S. PATENT DOCUMENTS 3,278,075 10/1966 Weiss ..... 206/197 X 3,355,012 11/1967 Weiss ..... 206/194 X 3,462,011 8/1969 Farquhar ..... 206/197 X

*Primary Examiner*—Jacob K. Ackun, Jr.

[57] ABSTRACT

Means for holding the bottoms of petaloid shaped bottles in place in a wrap-around carrier. Side panel apertures include flaps connected to the side panel by fold lines which are inwardly curved at their upper portions. The lower portions of each pair of flaps extend toward each other so as to engage one or more support feet of the adjacent bottle and be forced out from the side panel thereby. The curved portion of the fold lines biases the flaps against the support feet, regardless of which portion of the feet engage the flaps, to assist in holding the bottles in place within the carrier. Fold lines extending from the flap edges to the flap fold lines and hook-shaped slits at the upper ends of the flaps allow the side flaps to flex lengthwise.

20 Claims, 2 Drawing Sheets

FIG. 1
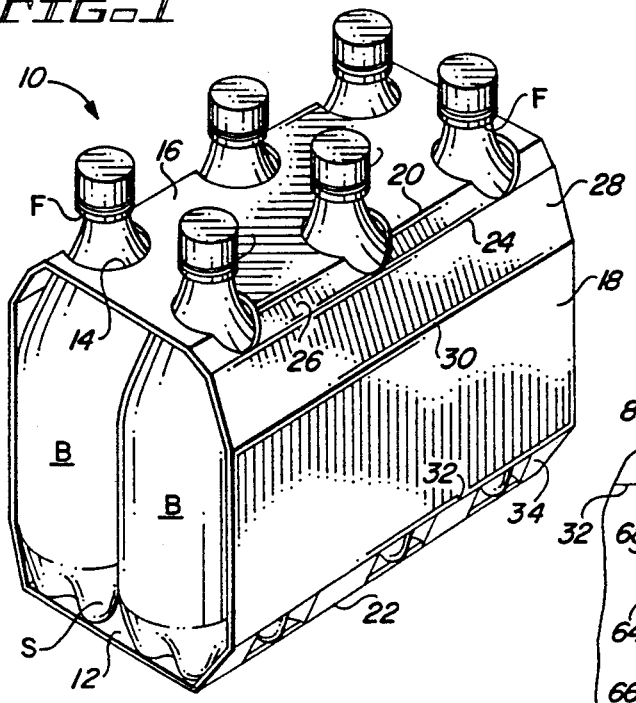
FIG. 4
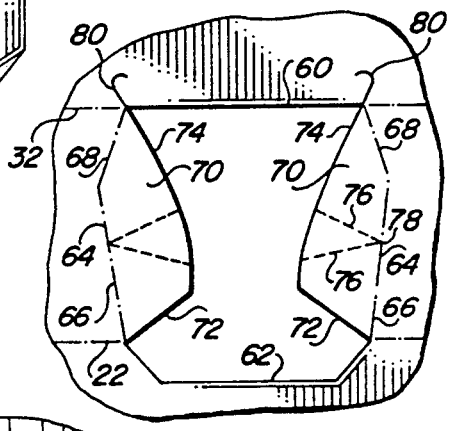
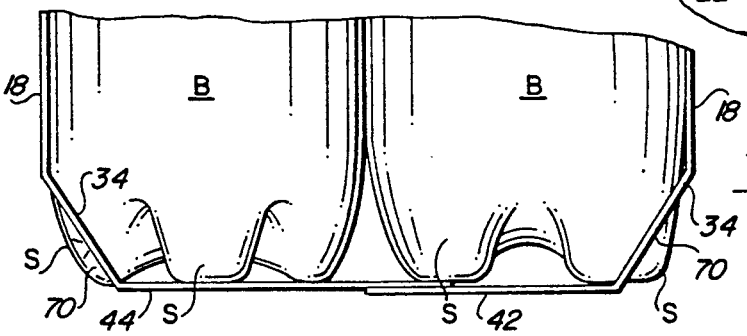
FIG. 2
FIG. 5
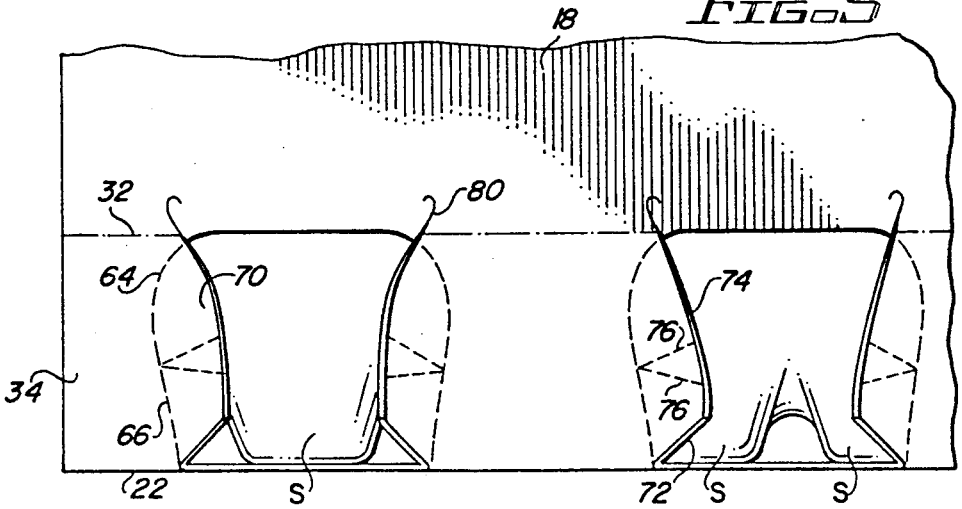

WRAP-AROUND CARRIER WITH FLEXIBLE HEEL APERTURE

FIELD OF THE INVENTION

This invention relates to wrap-around carriers which contain heel cutouts or apertures for holding the bottom portions of adjacent articles in place. More particularly, it relates to a wrap-around carrier capable of holding irregularly shaped bottom portions of articles in place.

BACKGROUND OF THE INVENTION

Wrap-around carriers are normally designed to accommodate the size and shape of the particular article to be packaged. In the case of beverage bottles, cutouts are conventionally provided in the side panels to allow the bottom or heel portion of the bottles to extend out beyond the side panel. Contact between the side edges of the cutouts and the bottles holds the lower portions of the bottles in place within the carrier to prevent the bottom from moving and falling out of the package. Since conventionally shaped bottles have bottom portions which are circular in cross section, the relationship between the bottle and the cutout remains the same regardless of which portion of the bottle is facing toward the cutout. The orientation of the bottles within the carrier at the time of packaging and during shipping is therefore not a consideration in designing the cutouts.

A problem arises when the bottle heels have varying contours of irregular shape. One such type of beverage bottle is formed of plastic and has a decorative bottom portion of petaloid shape. These bottles have support feet which are regularly spaced from each other about the periphery of the bottle. The sides of the support feet as well as the lower surface of the feet terminate at a point near the center of the bottom of the bottle, which is slightly higher than the bottom support surfaces of the feet. Thus when one views the bottom of the bottle, as in a plan view, the appearance of the bottom face is petaloid in nature, with the center area appearing to form the center of a flower and the support feet the petals.

Since the heel portions of petaloid bottles are not uniform, being broken up by the spaced support feet, the normal rotation of the bottles as they are moved into place for packaging makes it impossible to predict the exact portion of the heel which will be presented to a cutout at the time the carrier wrap is applied. Further, even if it were possible to orient the bottles so that the cutouts are able to fit the precise shape of the heel design presented at the time of packaging, rotational movement of the bottles in the package during shipping would tend to misalign the heel portions with the cutouts, rendering the cutouts ineffective. Aggravating the problem is the fact that petaloid bottles are sometimes formed with four support feet and sometimes with five, which would seem to require a different cutout for each type of bottle.

It would obviously be highly desirable to be able to lock petaloid shaped bottles in wrap-around carriers by means of a heel cutout capable of accommodating all the various configurations which such bottles are capable of presenting to the cutout. Furthermore, the means by which this is accomplished should not be expensive or require basic new machinery designs to carry out the packaging process.

BRIEF SUMMARY OF THE INVENTION

The invention provides a wrap-around carrier with cutouts or apertures in the side panels which are specially designed to accommodate articles having bottom portions which include spaced support feet. Each aperture is partially covered by side flaps connected on opposite sides of the aperture to the side panel along fold lines, the upper portions of which are curved toward each other. Each side flap is in contact with a support foot of an adjacent article, and in use is pivoted outwardly as a result of outward pressure applied by the articles. Because the curved portions of the side flaps bias the side flaps toward their closed positions, the side flaps urge the articles toward the interior of the carrier to assist in holding the articles in place within the carrier.

Preferably, flexing of the side flaps is enhanced by fold lines extending from the outer side edges of the side flaps to the side flap fold lines. In addition, a slit is preferably provided from the upper end of the curved portion of each side flap fold line into the side panel to prevent tearing in this critical area. To ensure adequate contact between the side flaps and the support feet, the lower portions of the side flaps of each aperture, which are adapted to contact the lower portions of the support feet, are spaced apart a lesser amount than higher portions of the flaps.

The invention is of special utility in connection with beverage bottles having petaloid shaped lower portions since the side flaps apply inwardly directed pressure against the support feet regardless of whether one or two support feet project through the cutout and regardless of the degree to which the feet extend out from the side panel. The carrier may be formed from a substantially rectangular sheet of blank material so that it is economical to produce and simple to apply.

The above and other aspects and benefits of the invention will readily be apparent from the more detailed description of the preferred embodiment of the invention which follows.

BRIEF DESCRIPTION OF THE DRAWING

FIG. 1 is a pictorial view of one embodiment of the wrap-around carrier of the invention;

FIG. 2 is an enlarged partial end view of the carrier of FIG. 1;

FIG. 4 is an enlarged plan view of the area enclosed by the circle 4 of FIG. 3; and FIG. 5 is an enlarged partial side elevation of the carrier of FIG. 1, showing different relationships between the support feet of the packaged bottles and the heel cutouts.

DETAILED DESCRIPTION OF THE PREFERRED EMBODIMENT

Figure 3:
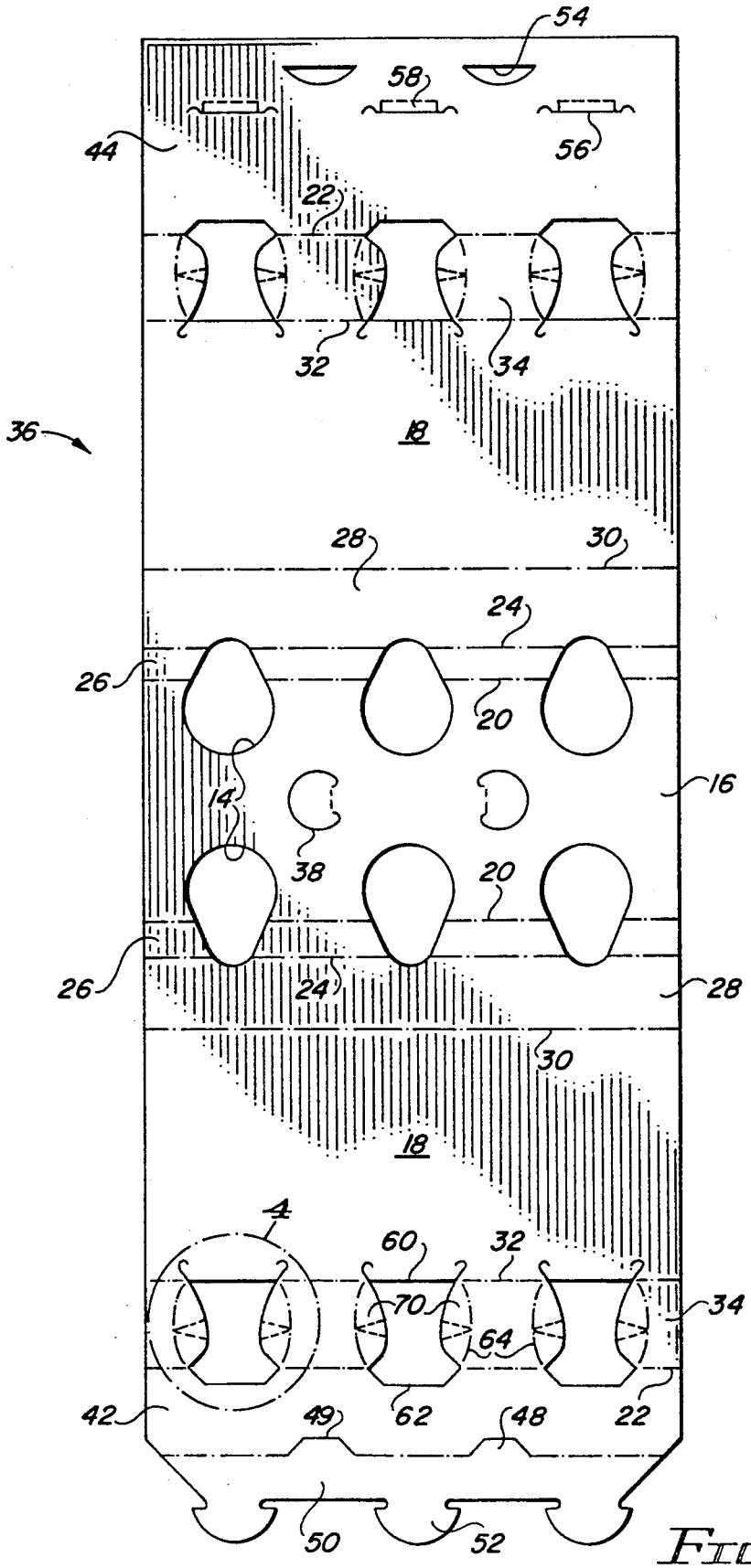
FIG. 3 is a plan view of a blank for forming the carrier of FIG. 1.

Referring to FIG. 1, the wrap-around carrier 10 is illustrated in connection with six beverage bottles B supported on bottom panel 12 and extending up through neck openings 14 in top panel 16. The bottles shown are plastic bottles having a relatively large diameter flange F located a short distance below the cap and a petaloid bottom portion including spaced support feet S. Side panels 18 are connected to the top panel along fold lines 20 and to the bottom panel along fold lines 22. Fold lines 24, which are parallel to and spaced a short distance from the fold lines 20, form a short first upper sloped panel portion 26 within the area of the side panels 1B. The sloped panel portion 26 contacts upper sloped portions of the bottles between the neck and barrel to hold the bottles securely in this area. A second upper sloped panel portion 28 is provided directly below the first sloped panel portion 26 by fold lines 30, spaced from the fold line 24 to more closely follow the contour of the bottles in this area. The bottle neck openings 14 extend into the first sloped panel portion 26 in order for the neck, which is relatively thick at this point, to be able to extend up through the top panel. Fold lines 32, which are parallel to and spaced a short distance from the fold lines 22, form a small lower sloped panel portion 34, which contacts the inwardly angled bottom portion of the petaloid shaped bottles. The petaloid bottoms and the arrangement of the lower portions of the bottles with the carrier panels are further illustrated in the partial end view of the carrier shown in FIG. 2.

Referring now to FIG. 3, wherein like reference numerals to those used in FIGS. 1 and 2 denote like elements, a blank 36 capable of being fabricated into the carrier of FIG. 1 is comprised of a central top panel section 16 connected at opposite sides by fold lines 20 to the sloped side panel sections 26. The top panel section includes the bottle neck openings 14 and also finger holes 38 for lifting the carrier. If the articles to be packaged do not have necks or are otherwise shaped so as not to extend through the top panel, the openings 14 would of course not be provided.

The fold lines 22 connect the lower sloped side panel portions 34 to bottom panel flaps 42 and 44. The bottom panel flap 42 includes a fold line 46 which extends the full length of the flap and which is interrupted by primary male locking tabs 48 formed by slits 49. The portion 50 of the flap 42 lying outwardly of the fold line 46 constitutes a locking panel which includes secondary male locking tabs 52. The bottom panel flap 44 includes cutouts having primary female locking edges 54 adapted to engage the primary male locking members 48 and slits 56 adapted to receive the secondary locking tabs 52. Tabs 58 are foldably connected to the bottom panel flap 44 a short distance outwardly of the slits 56 to facilitate entry of the locking tabs 52 into the slits. These various locking elements are illustrated to demonstrate a typical bottom panel locking arrangement suitable for use with the carrier of the invention, but it should be understood that any desired effective form of bottom panel locking means may be employed.

Referring to FIG. 4 as well as FIG. 3, each heel cutout comprises an aperture defined by edges 60 and 62 and flap fold lines 64. The edge 60 is aligned with and interrupts the fold line 32, while the edge 62 interrupts the fold line 22 but is not aligned with it, instead extending down from the fold line 22 into the bottom panel flap 42. Each flap fold line 64 is comprised of a lower straight portion 66 extending from an end of the aperture edge 62 and an upper curved portion 68 connected to the corresponding end of the aperture edge 60. The straight fold line portions 66 extend upwardly on diverging paths to points spaced farther apart than the ends of the upper edge 60 of the aperture, so that the curved fold line portions 68 follow convex paths.

The apertures are partially covered by side flaps 70 connected to the panel portions 34 by the fold lines 64. The flaps include lower converging tapered edge portions 72 and upper diverging curved edge portions 74. Fold lines 76 extend from spaced points on the curved edge portions 74 to an intersection point 78 on the straight fold line portion 66. In addition, slits 80 extend up from the upper ends of the fold lines 64 into the section of the side panel above the fold line 32, terminating in hook-shaped ends.

A package is formed from the carrier blank in conventional manner. The bottles are grouped together as they are to be arranged in the package and the top panel section of the blank 36 is placed on top of them, with the necks of the bottles extending through the bottle neck openings 14. The blank is then folded down and pulled tightly around the bottles, and the bottom panel flaps are locked together by the locking tabs to form the bottom panel. When the bottles are grouped together, no attention need be paid to the particular orientation of the support feet of the bottle, since the side flaps are able to compensate for variations in the locations of the support feet and the amounts that they protrude out beyond the lower side panel section 34.

It can be appreciated that there are a great many possible locations of the bottle support feet with respect to the heel apertures. The end aperture shown in FIG. 5 illustrates one such relationship where a support foot is located in the center of the aperture, which is the position that results in the support foot extending out from the carrier the greatest amount. As shown, the support foot S has pushed out against the side flaps 74 to cause them to pivot out from the carrier about their fold lines 64. The flaps tend to readily pivot about the straight fold line segments 66. The curved fold line segments 68, however, offer resistance to outward pivotal movement of the flaps, resulting in the flaps being biased toward their closed positions. If the flap fold lines were entirely linear, they would tend to take a set in the position to which they have been folded, which would not produce the inner biasing force required by the invention. The lengths of the straight and curved portions of the flap fold lines may vary as required in order to provide the desired biasing force. For example, in one preferred embodiment, the length of the curved portion is about onehalf the length of the straight portion.

Note that the flaps are not wide enough to engage the outermost portions of the support foot, but concentrate their engagement more on the side surfaces of the foot. Thus the inward pressure exerted by one of the side flaps of the aperture against the adjacent outer side surface of the support foot is opposed by the inward pressure exerted by the other side flap against the opposite outer side surface to thereby hold the support foot in place against movement within the carrier. Because the lower portions of the side flaps are more closely spaced apart than their upper portions, these flap portions engage relatively large areas of the support foot, thereby maximizing the biasing force applied to the foot. The slits 80 at the upper end of the curved fold line portion 68 allow stresses from the folding of the curved fold line portion 68 to be distributed into the side panel 18, with the hooked portions of the slits preventing tearing. The converging fold lines 76 provide additional flexibility to the side flaps 70, allowing them to flex along their length as required by the contour of the adjacent bottle support foot.

The other aperture shown in FIG. 5 illustrates the situation where the space between two support feet is at the center of the aperture. In this case each side flap engages a different support foot. Although the flaps are not folded out as much as in the previous situation, they nevertheless apply sufficient opposite biasing forces to hold the bottle in place. Relationships between the bottle support feet and the side flaps other than the two extremes illustrated will occur more frequently than the illustrated examples. In each case, however, the support foot engaging a flap will push the flap out enough so that the biasing force of the flaps against outward pivotal movement will be sufficient to hold the bottle in place. The side flaps are thus able to continue to perform their function even though the bottles in the carrier may rotate about their central axes during shipment.

The dimensions of the heel cutout aperture and its side flaps are such that for any particular bottle diameter the side flaps will perform their locking function for both four- and five-petal petaloid designs. This makes the carrier design extremely versatile, since changes from one carrier blank to another are less frequently required.

The carrier should be formed of a material which is sufficiently flexible to permit folding into final form and to provide the biasing properties required of the flap fold lines. Paperboard of the type typically employed in the carrier industry is the preferred choice, since it is economical, readily foldable, and its fibrous nature causes the curved portions of the side flap fold lines to be sufficiently biased toward the interior of the package.

Although the invention has been described primarily in connection with petaloid shaped bottles, it may be employed in connection with any article having a bottom portion comprised of interrupted support feet.

It should now be apparent that the invention is not necessarily limited to all the specific details described in connection with the preferred embodiment, but that changes to certain features of the preferred embodiment which do not alter the overall basic function and concept of the invention may be made without departing from the spirit and scope of the invention defined in the appended claims.

What is claimed is:

1. A wrap-around carrier package containing a plurality of articles having bottom portions which include spaced support feet, comprising:

opposite side panels foldably connected to top and bottom panels;

the side panels having bottom portions containing apertures opposite the bottom portions of adjacent articles;

each aperture being partially covered by opposed side flaps each connected to the side panel along a fold line, each side flap having an outer side edge portion spaced from the outer side edge portion of an opposed flap wherein each aperture is uncovered between the outer side edge portions of it's associated flaps.

The side flap fold lines of each aperture having upper portions which are curved toward each other and have an upper end portion, the upper end portions of the side flap fold lines of each aperture being spaced from each other;

each side flap being in contact with a support foot of an adjacent article, at least some of the side flaps being outwardly pivoted thereby;

the curved portions of the side flap fold lines biasing the side flaps toward the interior of the carrier to assist in holding the articles in place within the carrier; and flex enhancing fold lines extending from the outer side edge portion of each of the side flaps to the side flap fold lines, said flex enhancing fold lines acting to enhance the ability of the side flaps to flex along the length of said side flaps.

2. A wrap-around carrier package according to claim 1, wherein the flex enhancing fold lines comprise a plurality of converging fold lines extending from the outer side edge of each side flap to a point on the side flap fold line.

3. A wrap-around carrier package according to claim 1, including a slit extending from the upper end of the curved portion of each side flap fold line into the side panel.

4. A wrap-around carrier package according to claim 3, wherein each slit terminates in the side panel in a hooked end portion.

5. A wrap-around carrier package according to claim 1, wherein the side flap fold lines of each aperture include straight lower portions extending up to the curved fold line portions along diverging paths.

6. A wrap-around carrier package according to claim 5, wherein the curved portions of the flap fold lines are about one-half the length of the straight lower flap fold line portions.

7. A wrap-around carrier package according to claim 1, wherein the outer side edge portions of the side flaps associated with each aperture include lower portions which are spaced apart a lesser amount than higher portions of the side flaps.

8. A wrap-around carrier package according to claim 7, wherein the lower more closely spaced side edge portions of the side flaps are located beneath said flex enhancing fold lines.

9. A wrap-around carrier package according to claim 1, wherein each side panel includes a substantially vertical portion and an inwardly sloped portion between the vertical portion and the bottom panel, the sloped portion being connected to the vertical portion along a fold line interrupted by the upper edges of the apertures.

10. A wrap-around carrier package according to claim 9, wherein the upper portions of the side flap fold lines terminate at the interrupted fold line.

11. A wrap-around carrier package according to claim 7, wherein the lower portions of the side flap fold lines terminate at the foldable connection between the associated side panel and the bottom panel.

12. A wrap-around carrier package according to claim 11, wherein the apertures extend into the bottom panel.

13. A wrap-around carrier package according to claim 1, wherein the bottom portions of the articles are of petaloid shape, the support feet being regularly spaced about the periphery of the article and sloping upwardly and radially inwardly of the article.

14. A wrap-around carrier package according to claim 13, wherein the articles are beverage bottles.

15. A wrap-around carrier package containing a plurality of beverage bottles having petaloid shaped bottom portions which include spaced support feet, comprising:

opposite side panels foldably connected to top and bottom panels;

the side panels having bottom portions containing apertures opposite the bottom portions of adjacent bottles;

each aperture being partially covered by opposite side flaps each connected to the side panel along a fold line, each side flap having an outer side edge portion spaced from the outer side edge portion of an opposed flap wherein each aperture is uncovered between the outer side edge portions of it's associated flaps;

the side flap fold lines of each aperture having upper portions which are curved toward each other and having an upper end portion, the upper end portions of the side flap fold lines of each aperture being spaced from each other;

the distance between the side flaps of each aperture and the distance between the side flap fold lines of each aperture being related to the dimensions of the support feet so that each flap is in contact with and outwardly pivoted by a support foot of an adjacent bottle, curved portions of the side flap fold lines biasing the side flaps toward the interior of the carrier to assist in holding the bottles in place within the carrier and a slit extending from the upper end portion of the curved portion of each side flap fold line and terminating in the side panel in a hooked end portion,

16. A wrap-around carrier package according to claim 15, including flex enhancing fold lines extending from the outer side edge of each side flap to a point on the side flap fold lines, the side edges of the side flaps associated with each aperture including lower portions which are spaced apart a lesser amount than higher portions of the flaps.

17. A wrap-around carrier package according to claim 15, wherein each side panel includes a substantially vertical portion and an inwardly sloped portion between the vertical portion and the bottom panel, the sloped portion being connected to the vertical portion along a fold line interrupted by slits forming part of the apertures, the upper ends of the side flap fold lines terminating at the interrupted fold line.

18. A generally rectangular blank for forming a wrap-around carrier adapted to package a plurality of articles having bottom portions which include spaced support feet, comprising:

a first side panel section foldably connected to and positioned between a top panel section and a first bottom panel section, and a second side panel section foldably connected to and positioned between said top panel section and a second bottom panel section;

portions each of the side panel sections adjacent the bottom panel sections containing apertures for positioning opposite the bottom portions of adjacent articles in a carrier formed from the blank;

each aperture being partially covered opposed side flaps each connected to the side panel section along a fold line each side flap having an outer side edge portion spaced from the wherein each aperture is uncovered between the outer side edge portions of its associated flaps;

the side flap fold lines of each aperture having portions on an end of each aperture opposite said bottom panel sections; which are curved toward each other, each curved portion having an end portion, the end portions of the side flap fold lines of each aperture being spaced from each other;

said flaps for contacting with a support foot of an adjacent article carried in a carrier formed from the blank whereby at least some of the side flaps are for pivoting outwardly by the support feet of an article in a carrier formed from the blank;

the curved portions of the side flap fold lines biasing the side flaps toward the interior of 9 carrier formed from the blank to assist in holding the articles in place within the carrier; and flex enhancing fold lines extending from the outer side edges of each of the side flaps to the side flap fold lines.

19. A wrap-around carrier blank according to claim 18, including a slit extending from the end portion of the curved portion of each side flap fold line and terminating in the adjacent side panel section in a hooked end portion.

20. A wrap-around carrier blank according to claim 18, wherein the outer side edge portions of the side flaps associated with each aperture include portions adjacent said bottom panel sections which are spaced apart a lesser amount than other portions of the flaps.

* * * * *